US008806719B2

(12) United States Patent
Kleeman et al.

(10) Patent No.: US 8,806,719 B2
(45) Date of Patent: Aug. 19, 2014

(54) DOOR HINGE FOR A HOUSEHOLD APPLIANCE

(71) Applicants: Andreas Kleeman, Kalletal (DE); Mark Schneider, Porta Westfalica (DE)

(72) Inventors: Andreas Kleeman, Kalletal (DE); Mark Schneider, Porta Westfalica (DE)

(73) Assignee: Hettich-Oni GmbH & Co. KG, Vlotho (DE)

( * ) Notice: Subject to any disclaimer, the term of this patent is extended or adjusted under 35 U.S.C. 154(b) by 0 days.

(21) Appl. No.: 13/934,949

(22) Filed: Jul. 3, 2013

(65) Prior Publication Data

US 2013/0312217 A1 Nov. 28, 2013

Related U.S. Application Data

(62) Division of application No. 12/676,208, filed as application No. PCT/EP2008/061327 on Aug. 28, 2008, now abandoned.

(30) Foreign Application Priority Data

Sep. 7, 2007 (DE) ..... 20 2007 012 603 U

(51) Int. Cl.
*E05F 1/08* (2006.01)

(52) U.S. Cl.
USPC ..... 16/286

(58) Field of Classification Search
USPC ..... 16/286, 289, 290, 292, 321, 322, 306; 49/386, 387, 389, 398, 402; 126/190, 126/191, 192, 194; 312/323, 325, 326
See application file for complete search history.

(56) References Cited

U.S. PATENT DOCUMENTS

| | | | | |
|---|---|---|---|---|
| 4,102,004 | A | 7/1978 | Nagase | |
| 4,658,473 | A | 4/1987 | Schema | |
| 5,896,619 | A * | 4/1999 | Koopman | 16/50 |
| 6,262,548 | B1 * | 7/2001 | Scholten et al. | 318/445 |
| 6,397,836 | B1 | 6/2002 | Pelletier et al. | |
| 6,684,453 | B2 * | 2/2004 | Wang | 16/50 |
| 7,096,535 | B2 | 8/2006 | Lin | |
| 7,406,749 | B2 | 8/2008 | Herper | |
| 2003/0056328 | A1 * | 3/2003 | Habegger et al. | 16/343 |
| 2003/0200625 | A1 * | 10/2003 | Zimmer | 16/306 |
| 2007/0209654 | A1 * | 9/2007 | Wang | 126/194 |
| 2007/0283532 | A1 | 12/2007 | Vanini | |
| 2008/0168618 | A1 | 7/2008 | Hottmann | |
| 2010/0101052 | A1 | 4/2010 | Waltemate et al. | |
| 2010/0109497 | A1 | 5/2010 | Blersch et al. | |
| 2010/0148646 | A1 | 6/2010 | Bettinzoli | |

FOREIGN PATENT DOCUMENTS

| | | |
|---|---|---|
| DE | 10 2005 002 822 | 8/2006 |
| EP | 0 155 372 | 9/1985 |
| EP | 1 847 670 | 10/2007 |

* cited by examiner

*Primary Examiner* — Chuck Mah
(74) *Attorney, Agent, or Firm* — Barnes & Thornburg LLP

(57) ABSTRACT

A door hinge for a household appliance, the household appliance including a body and a door, the door being movable about a horizontal axis between a substantially vertical closed position and a substantially horizontal opened position. The door hinge includes a housing couplable to the body, a door lever pivotably mountable on the door for movement about a main shaft, a weight compensating spring and a closing spring. The weight compensating spring holds the door substantially in a position of equilibrium when the door is opened and the closing spring applies a self-closing force shortly before the door reaches the closed position and applies a closure maintaining force when the door reaches the closed position. Further included is a dampening device that counteracts one or both of a closing force and an opening force.

9 Claims, 11 Drawing Sheets

Fig. 17
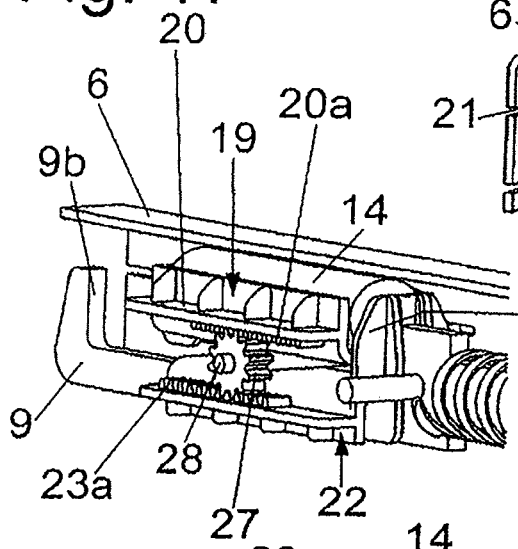
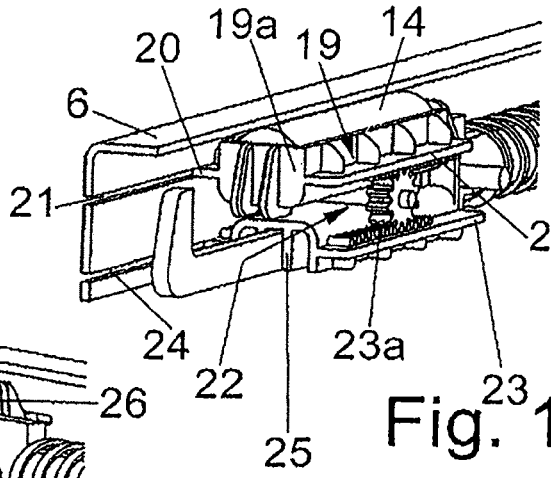
Fig. 16
Fig. 18
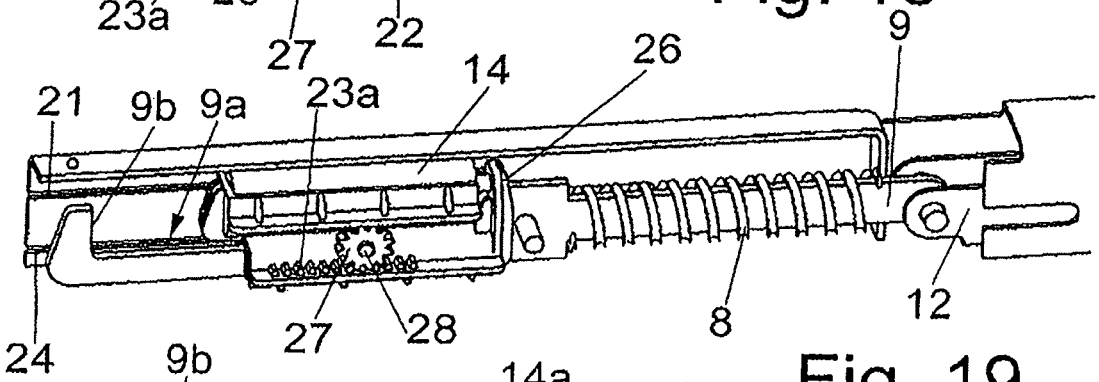
Fig. 19
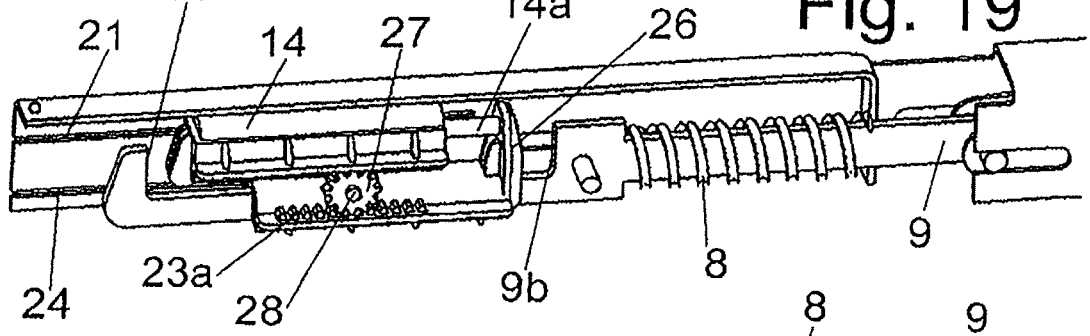
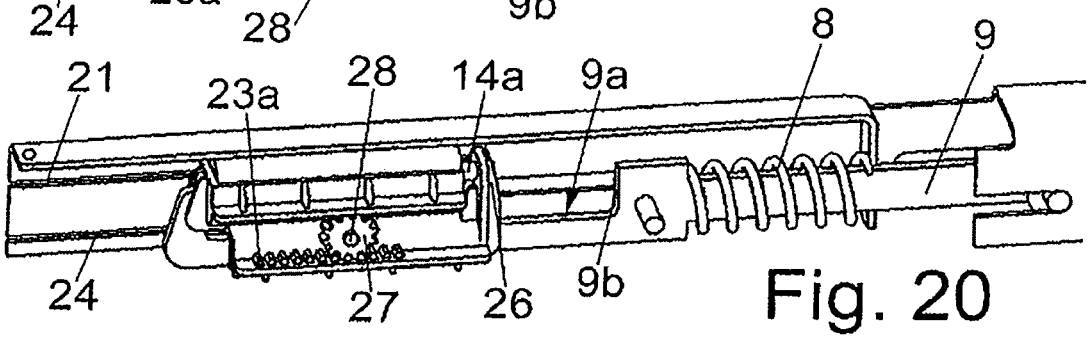
Fig. 20

Fig. 21
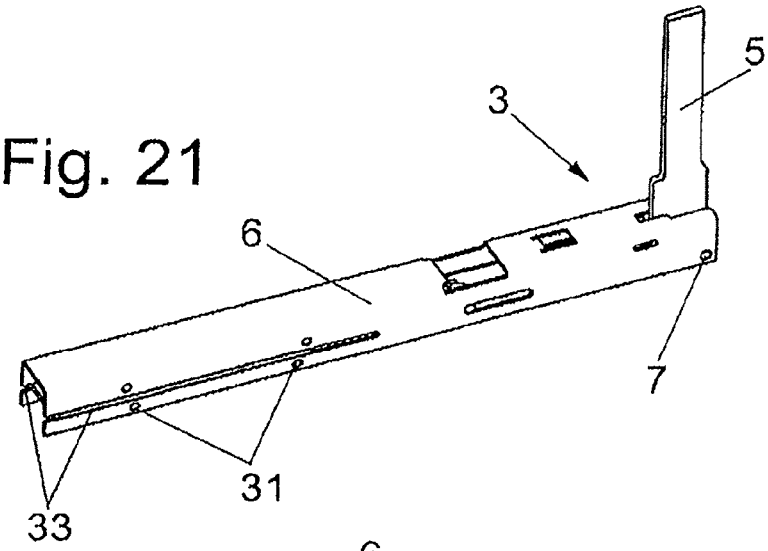
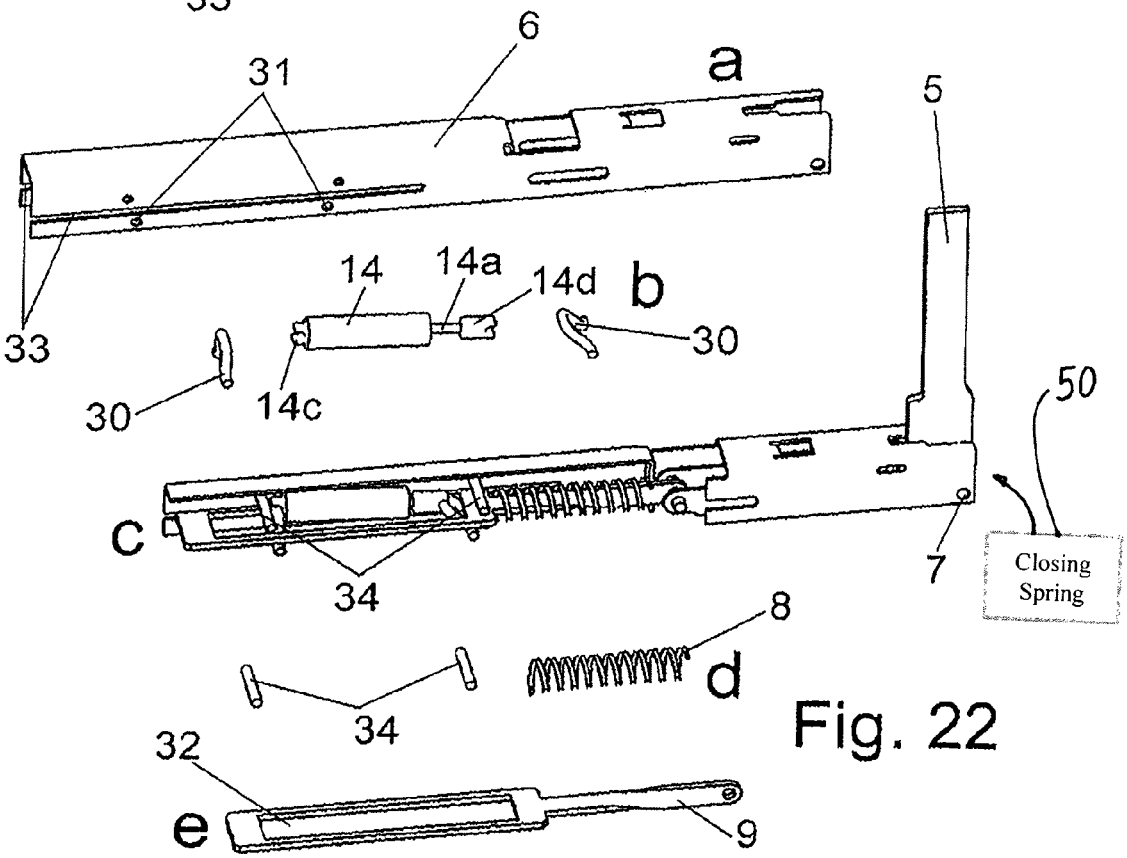
Fig. 22

DOOR HINGE FOR A HOUSEHOLD APPLIANCE

This is a Divisional Application of Non-Provisional patent application Ser. No. 12/676,208, filed on Jul. 13, 2010, and the disclosure of that application is hereby incorporated by reference herein. application Ser. No. 12/676,208 is a §371 of PCT/EP2008/061327, filed on Aug. 28, 2008, which claims benefit of German Application Number 20 2007 012 603.4 filed on Sep. 7, 2007.

The present disclosure relates to a door hinge of a household appliance, for example, an oven, a dishwasher or the like. A door is movable about a lower horizontal axis from an approximately vertical closed position into an approximately horizontal open position. The door hinge includes a door lever mountable on the door, a housing fastenable to a body of the household appliance, to which housing the door lever is connected so as to be pivotable about a main shaft. Further included is a weight compensation spring as well as a closing spring, the weight compensation spring holding the door approximately in a position of equilibrium when the door is opened and the closing spring applying a self-closing force shortly before the door reaches a closed position and subsequently applying a closure maintaining force.

Door hinges of the above-mentioned type are known.

In the case of such door hinges, the weight compensation springs have the purpose of largely absorbing the gravitational forces occurring when a door is opened about a horizontal lower axis and preventing an uncontrolled swinging-open of the door. Conversely, the weight compensation spring will clearly facilitate the lifting-up of the door from an opened position.

The closing spring has the purpose of acting upon the door shortly before it reaches the final closed position by a spring force acting in the closing direction and thus initiating a self-closure. In addition, the closing spring has the effect that, in the closed condition, the door is maintained in the closed position by the force of the closing spring.

The present disclosure provides for a door hinge of the above-mentioned type but which causes an improvement of the movement sequences when opening or closing a door, particularly in final position ranges.

According to the present disclosure, a damping device is provided which counteracts the closing forces shortly before the final closed position of the door is reached and/or the opening forces shortly before the final opened position of the door is reached.

By a damping device of this type, a damping force is opposed to the closing and/or opening forces acting in the closing and/or opening direction upon the door. Such a damping force is slightly lower than the respective closing and/or opening force, so that, although the closing and/or opening of the door is not hindered, it is clearly damped in the final positions.

The movement sequences during the opening and/or closing of a corresponding door are thereby clearly improved. Likewise, impact noises when reaching the closed and/or opened position are largely prevented.

According to the present disclosure, it is provided that the damping device includes a damping cylinder that can be acted upon on both sides.

In the case of a comparatively simple and cost-effective construction, according to the present disclosure, when the closed position is reached or the opened position is reached, the damping cylinder is loaded from its opposite faces, with the result that the damping forces are the same in the closing direction as well as in the opening direction.

According to an embodiment of the present disclosure, it is provided that the damping device includes two damping cylinders, one damping cylinder being provided for the damping of the closing forces and the other damping cylinder being provided for the damping of the opening forces.

Such a slightly more expensive construction has the advantage that, during the closing operation, the damping forces can be adjusted independently of the damping forces during the opening operation.

Other aspects of the present disclosure will become apparent from the following descriptions when considered in conjunction with the accompanying drawings.

BRIEF DESCRIPTION OF THE DRAWINGS

FIGS. 16 and 17 are partial perspective views of the door hinge of FIG. 15 from different viewing angles.

FIGS. 18 to 20 are views of the door hinge of FIG. 15 in different pivoting positions.

FIG. 21 is a perspective view of another embodiment of a door hinge, according to the present disclosure.

FIGS. 22*a* to *e* are a composite exploded view of the door hinge of FIG. 21.

DETAILED DESCRIPTION

Figure 1:
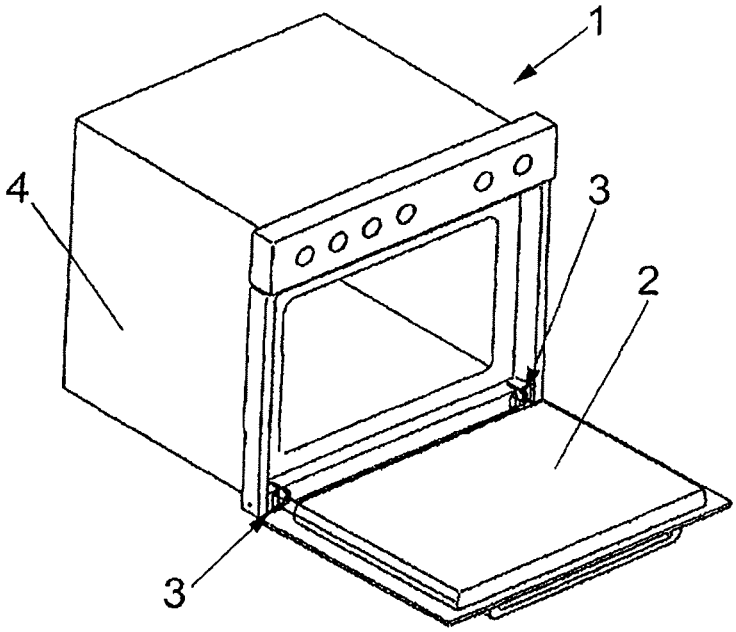
FIG. 1 is a perspective view of an oven when the door is open.

In FIG. 1, reference number 1 indicates an oven as a whole, in which a door 2 is connected to a body 4 by two door hinges 3 so as to be pivotable about a lower horizontal axis.

FIG. 1 shows the position of the door hinges 3 in a mounted condition.

Various embodiments of door hinges 3 are described therein.

Figure 2:
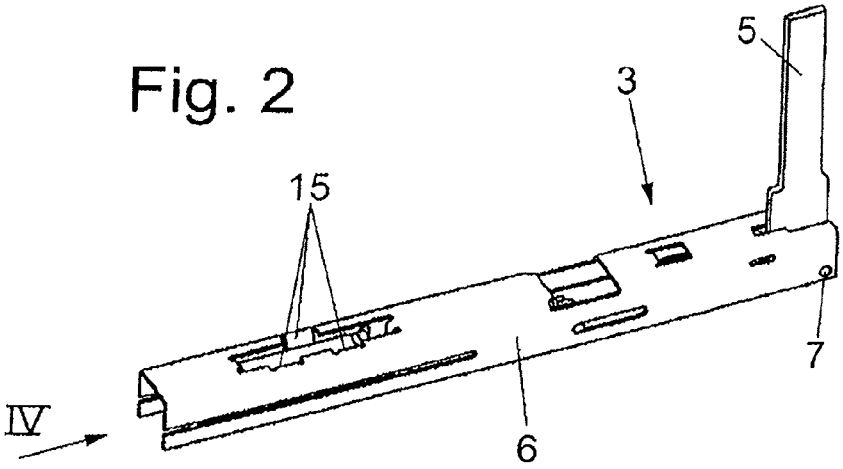
FIG. 2 is a perspective view of an embodiment of a door hinge, according to the present disclosure.
Figure 3:
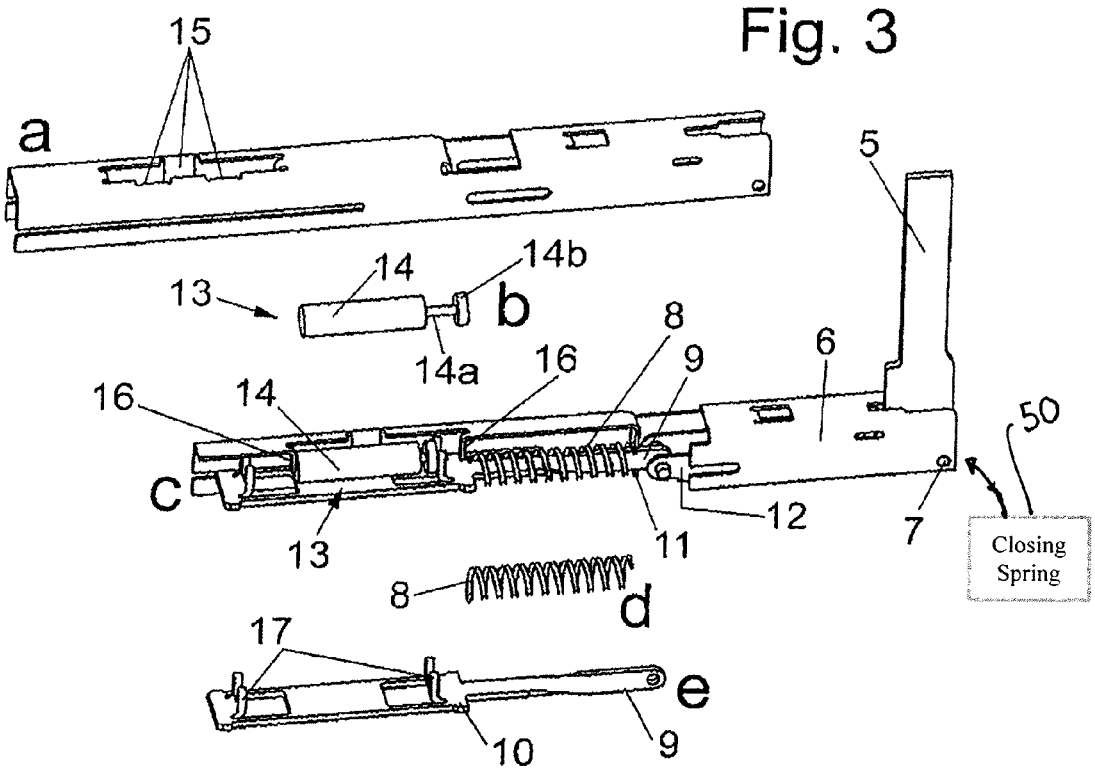
FIGS. 3*a* to 3*e* are a composite exploded view of the door hinge of FIG. 2.
Figure 4:
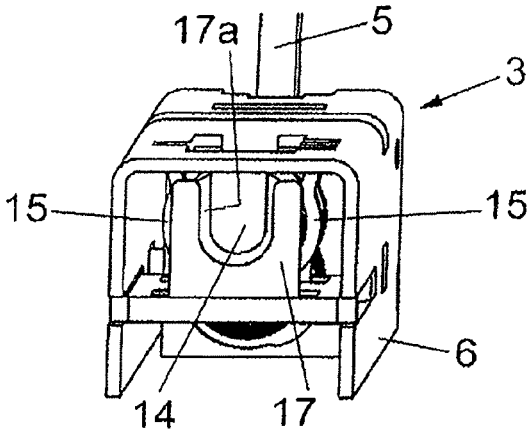
FIG. 4 is a view in the direction of the arrow IV in FIG. 2.
Figure 5:
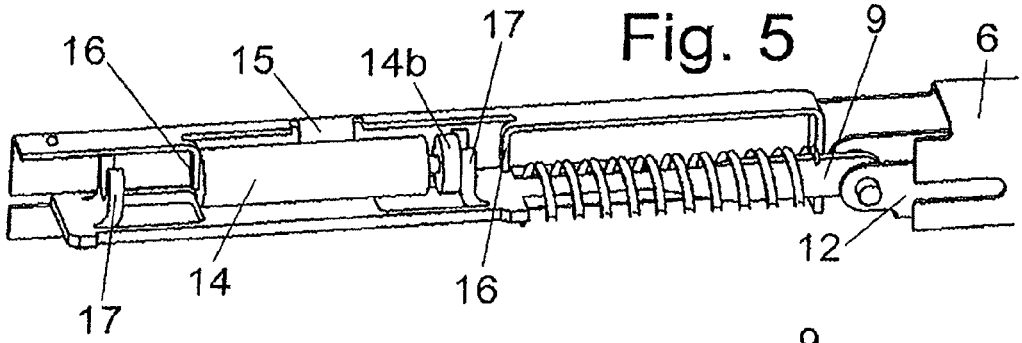
FIGS. 5 to 7 are views of the door hinge of FIG. 3 in different pivoting positions.

With reference to FIGS. 2 and 3, a basic construction of a door hinge is described first, in accordance with the present disclosure.

A door hinge 3 comprises a door lever 5 mountable on the door 2 and a housing 6 mountable on a body 4 of an oven 1. In accordance with the present disclosure, door hinge 3 is mountable on, for example, a comparable household appliance. A door lever 5 is connected with the housing 6 so as to be pivotable about a main shaft 7. The main shaft 7 corresponds to the axis about which the door 2 is pivoted with respect to the body 4.

Furthermore, the hinge 3 includes a weight compensation spring 8 which has a purpose of maintaining the door 1 approximately in a position of equilibrium. Spring characteristics described so far may be generally known. A closing spring 50 is shown in FIGS. 3C, 9C, 15C, 21C, and 28C. A task of the closing spring 50 is to pivot the door 2 into its closed position without the effect of external forces shortly before the final closed position has been reached and therefore cause a self-closing. Furthermore, it is a purpose of the closing spring 50 to press the door 2 against the body 4 in the closed position.

A linkage of bars or bar linkage 9 extends through the weight compensation spring 8, which weight compensation spring 8 is supported by one of its ends on a stop 10 of the linkage of bars 9 and, by way of its other end, on a supporting lug 11 of the housing 6.

The end of the linkage of bars 9 facing the door lever 5 is connected with a transmission lever 12 which, in a known manner, is pivotable about a secondary axis offset with respect to the main shaft 7 connected to the door lever 5. This has the result that, during the opening of the door 2, the linkage of bars 9 is pulled by way of the transmission lever 12 in the direction of the face of the body 4, whereby the weight compensation spring 8 is shortened, thus preventing an uncontrolled dropping-down of the door 2.

Conversely, during the closing of the door 2, the external force required for lifting and closing the door 2 will be reduced by the weight compensation spring 8.

Shortly before the final closed position has been reached, the above-mentioned closing spring 50 will be activated in a known manner, by which closing spring 50, before the final closed position, the door 2 is moved in the last angular area into its closed position solely by the force of the above-mentioned closing spring 50. Furthermore, the door 2 is also held in the closed position by the force of the closing spring 50.

In addition, to this known method of operation, which all embodiments according to the present disclosure have in common, each door hinge 3, according to the present disclosure, is equipped with a damping device 13.

The damping device 13, as shown, for example, in an embodiment according to FIGS. 2 to 7, may include a damping cylinder 14 or, as shown, for example, in the embodiment according to FIGS. 8 to 13, may include two damping cylinders 14. Damping devices 13, each having one damping cylinder 14, are also shown, for example, in the embodiments according to FIGS. 14 to 20 as well as FIGS. 21 to 26. A damping arrangement or device 13 including two damping cylinders 14 is shown, for example, in the embodiment according to FIGS. 27 to 33.

A construction and function of the damping arrangement or device 13 is further described below.

In the embodiment according to FIGS. 2 to 7, the damping cylinder 14 is held inside the housing 6 by contour lugs 15 bent from the housing 6 toward the interior but can still be displaced axially. Furthermore, in the area of the damping cylinder 14, contact lugs 16 situated in the axial direction of the damping cylinder 14 and projecting into the housing interior are provided at the housing 6. The mutual distance between these two contact lugs 16 is less than the mutual distance between two bevels 17 provided at the linkage of bars 9 and projecting into the damping cylinder 14. In addition, the bevels 17 of the linkage of bars 9 are provided with recesses 17*a* in the center, whose base is larger than the base of the contact lugs 16 of the housing 6.

At the free end of the piston rod 14*a* of the damping cylinder 14, a piston stop 14*b* is fastened whose base is larger than the base of the piston rod 14*a*.

Figure 6:
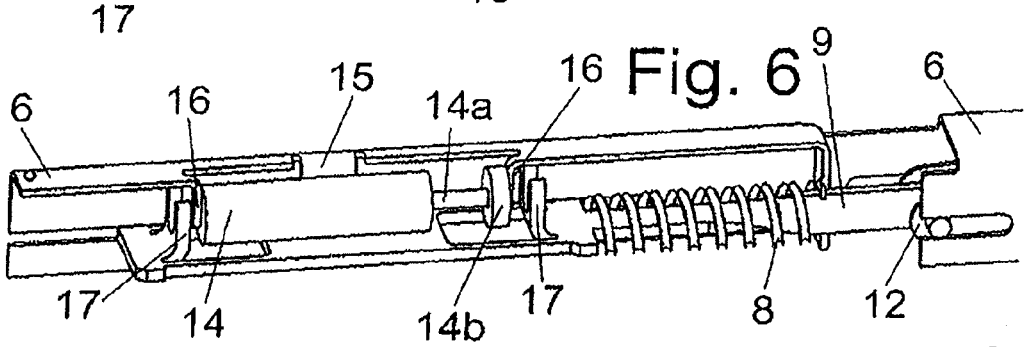
Figure 7:
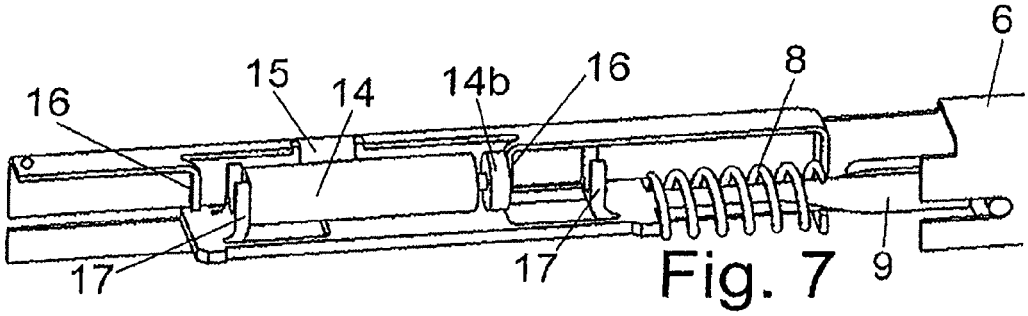
Figure 8:
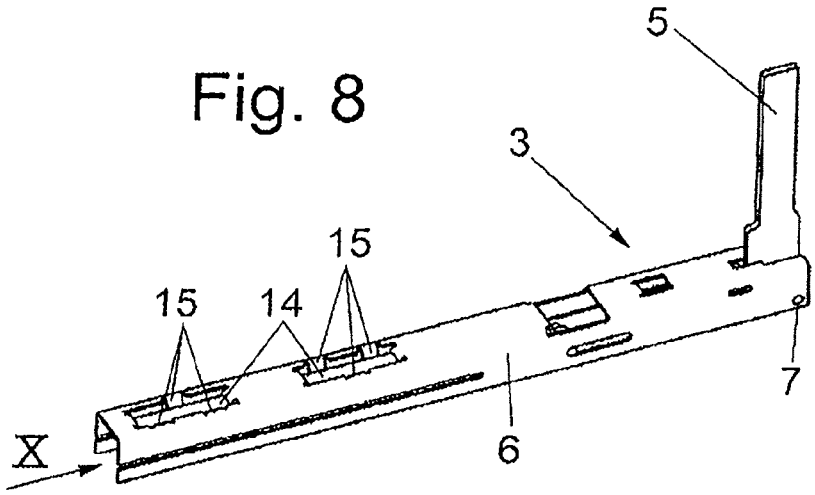
FIG. 8 is a perspective view of another embodiment of a door hinge, according to the present disclosure.
Figure 9:
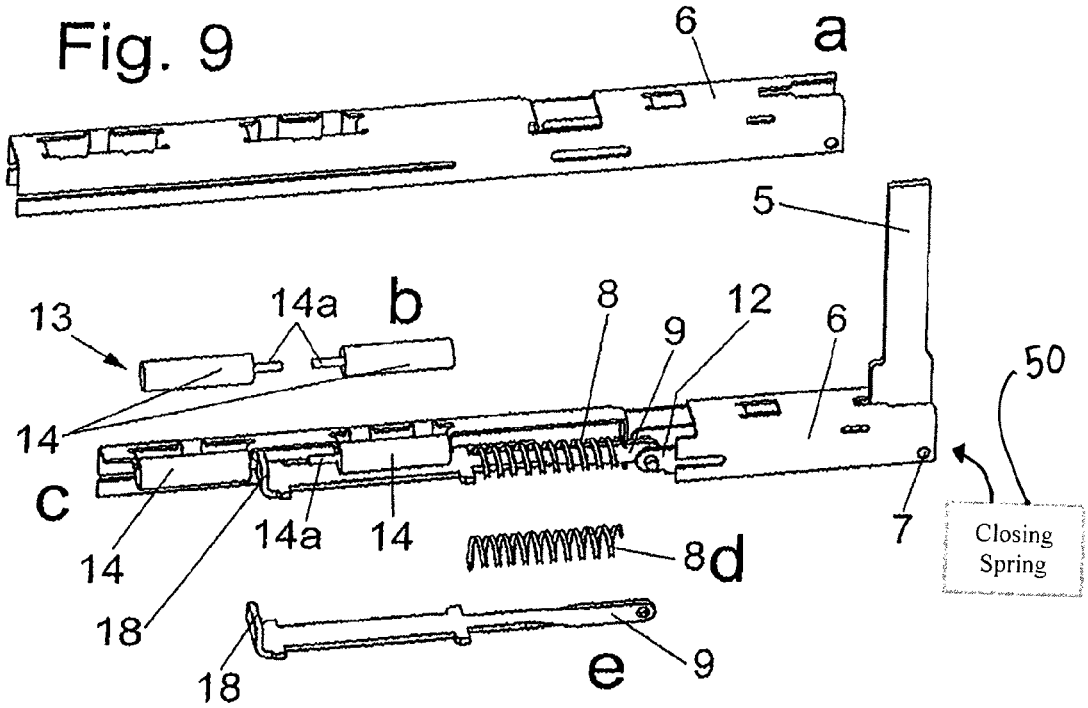
FIGS. 9*a* to *e* are a composite exploded view of the door hinge of FIG. 8.
Figure 10:
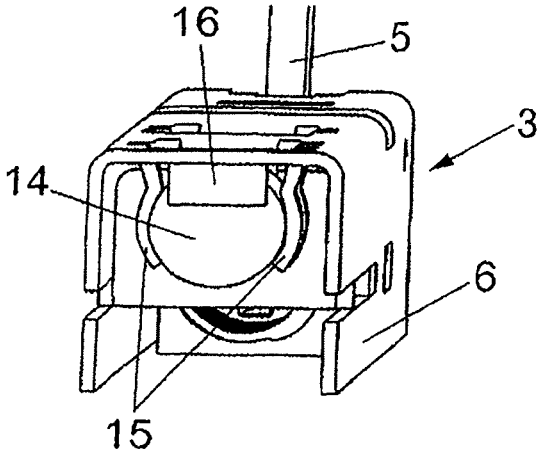
FIG. 10 is a view in the direction of the arrow X in FIG. 8.

When the door 2 of a household appliance is in an intermediate opening position with an opening angle of approximately 44°, as suggested or represented, for example, in FIG. 6, the damping cylinder 14 will rest with its face-side end against a contact lug 16 and the piston stop 14*b* rests on the other contact lug 16 of the housing 6. In this intermediate position, the bevels 17 of the linkage of bars 9 have no contact with the damping cylinder 14 or its piston rod 14*a*.

When the door 2 is now moved from this intermediate position in the closing direction, the linkage of bars 9 will be moved toward the left by way of the transmission lever 12. As a result, the front bevel 17 of the linkage of bars 9 facing the door side is caused to contact the piston stop 14*b* and presses the piston rod 14 into the damping cylinder 14. The closing movement is thereby damped corresponding to the design of the damping cylinder 14.

When the door 2 is moved farther from the intermediate position, which is illustrated in FIG. 6, into the opening direction, by way of the rear bevel 17 of the linkage of bars 9 facing away from the door 2, the housing 6 of the damping cylinder 14 is displaced toward the right so that the piston rod 14*a* still supported on the face-side contact lug 16 is again pushed into the damping cylinder 14 and thereby the opening movement is also damped in the last angular area. In the case of this relatively simple construction which can be implemented in a cost-effective manner, the damping forces are therefore of the same magnitude during the opening operation as well as during the closing operation.

In the embodiment of the present disclosure according to FIGS. 8 to 13, the damping arrangement 13 includes two damping cylinders 14 which are disposed in the housing 6 at a distance from one another while their piston rods 14*a* point toward one another. The damping cylinders 14 are, in turn, held in the housing 6 by contour lugs 15 and are secured against a longitudinal displacement by contact lugs 16 bent into the housing 6, which contact lugs 16 contact the two faces of the respective damping cylinder 14.

On its rearward end facing away from the door 2, the linkage of bars 9 is provided with a beveled driving lug 18 which projects into the housing 6 and is disposed between the mutually opposite piston rods 14*a* of the damping cylinders 14.

Figure 12:
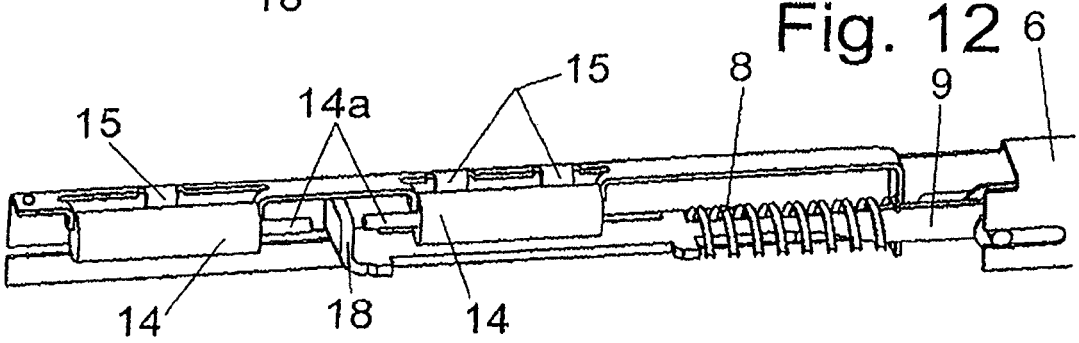

Starting from an intermediate opening position of the door 2, for example, at approximately 44°, corresponding to that shown in FIG. 12, the driving lug 18 of the linkage of bars 9 is situated between the mutually facing piston rods 14*a* of the two damping cylinders 14. The piston rods 14*a* have moved out.

Figure 11:
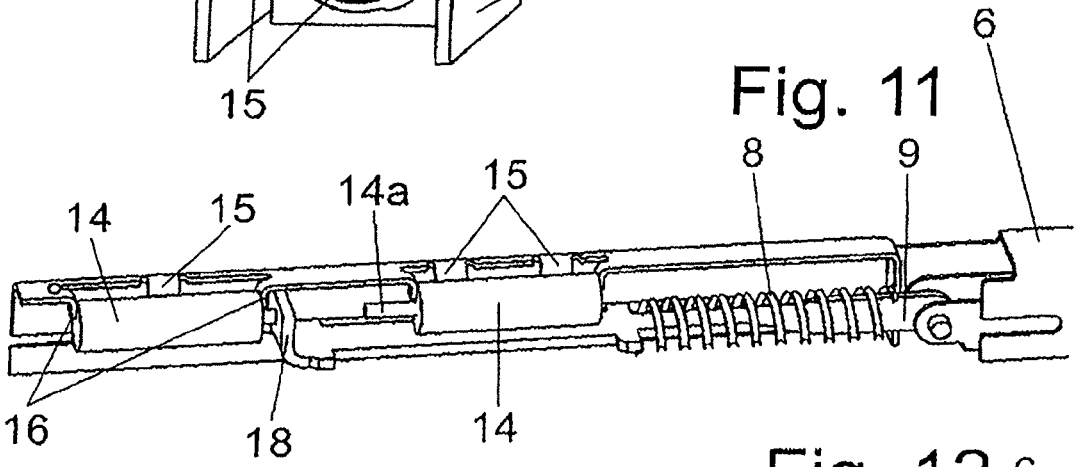
FIGS. 11 to 13 are views of the door hinge of FIG. 9 in different pivoting positions.

When the door 2 is now moved out of this intermediate position into the closing direction, the linkage of bars 9 will move to the left to an end position, as shown in FIG. 11. In the process, the driving lug 18 of the linkage of bars 9 impacts on the piston rod 14*a* of the rear damping cylinder 14 facing away from the door 2 and pushes this piston rod 14*a* into the damping cylinder 14. In this case, the closing movement is damped corresponding to the characteristics of the damping cylinder 14.

When the door 2 is moved from the intermediate position according to FIG. 12 farther into the opening direction, the linkage of bars 9 will move to the right, in which case the driving lug 18 will then impact on the piston rod 14*a* of the forward damping cylinder 14 facing the door 2. While achieving a damping effect of the closing movement, the piston rod 14*a* will be pushed into the forward damping cylinder 14 until the final opening movement takes place.

Although this construction requires slightly higher expenditures and also becomes somewhat more expensive because of the use of two damping cylinders 14, it offers the advantage of being able to use damping cylinders 14 with different damping characteristics, which advantage should not be underestimated. Thus, the damping effect for the closing movement can be designed independently of the damping effect for the opening movement.

Another advantage is the fact that, when one damping cylinder 14 fails, the effect of the remaining other damping cylinder 14 will not be impaired so that, as required, the damping effect will fail only during the closing or the opening of the door 2.

In the embodiments of the present disclosure described so far, only the displacement path of the linkage of bars 9 is available as the damping path.

The damping effect may be improved by an enlargement of the effective damping path, a description of which follows.

FIGS. 14 to 20 show a door hinge 3 including one damping cylinder 14. This damping cylinder 14 is disposed in an upper housing 19 that is open toward its top. This upper housing 19 is open on the face-side in the direction of the door 2 and is closed by a rear wall 19*a* on its rearward side facing away from the door 2. The damping cylinder 14 is inserted in the upper housing 19 such that the piston rod 14*a* protrudes beyond the open side of the upper housing 19 in the direction of the door 2.

Furthermore, the upper housing 19 is provided with two lateral guide ribs 20 which engage in lateral guide grooves 21 of the housing 6 and thereby permit a longitudinal displacement of the upper housing 19 relative to the housing 6.

Toothed-rack-type areas 20*a* are arranged on the underside of the guide ribs 20.

Furthermore, a lower housing 22 is provided which, by way of lateral guide webs 23, is longitudinally displaceably guided in guide slots 24 of the housing 6. As on the opposite underside of the upper housing 19, toothed areas 23*a* are arranged on the top side of the guide webs 23. The lower housing 22 is spaced from the upper housing 19 and is provided with a guide groove 25 on its underside, into which guide groove 25 the linkage of bars 9 engages in the area of a recess 9*a*. At its forward end facing the door 2, the lower housing 22 is equipped with a face wall 26 which extends into the displacement area of the piston rod 14*a* of the damping cylinder 14.

Between the upper housing 19 and the lower housing 22, gears 27 are provided on both sides which, by way of an axis of rotation fastened to the housing 6, are rotatably disposed in the housing 6. These two gears 27 mesh with the toothed areas 20*a* of the upper housing 19 and 23*a* of the lower housing 22.

The recess 9*a* of the linkage of bars 9 is bounded on the face side by stop edges 9*b*.

In an intermediate opening position of the door 2 at approximately 44°, corresponding to the position of the hinge 3 as shown in FIG. 19, the two stop edges 9*b* each have the same distance from the face wall 26 of the lower housing 22 and from the rear wall 19*a* of the upper housing 19.

When the door 2 is now moved from this intermediate opening position upward in the closing direction, the linkage of bars 9 will be displaced to the left from the position shown in FIG. 19 until the stop edge 9*b* adjacent to the face wall 26 comes to rest on this face wall 26. A further displacement of the linkage of bars 9 in the same direction will then cause an action on the piston rod 14*a* of the damping cylinder 14 and, furthermore, by way of the synchronization of the upper housing 19 with the lower housing 22 by the gears 27, a relative displacement will be caused between the lower housing 22 and the upper housing 19. In this case, the piston rod 14*a* will be pushed into the housing of the damping cylinder 14 and the closing movement is correspondingly damped.

When the door 2 is further pivoted from the intermediate opening position in the opening direction, the linkage of bars 9 is correspondingly displaced to the right. In this case, the stop edge 9*b*, which is in the rear facing away from the door, first will come to rest against the rear wall 19*a* of the upper housing 19 and, as a result of a further displacement of the linkage of bars 9 in the same direction, again while simultaneously carrying out a relative displacement between the upper housing 19 and the lower housing 22, the piston rod 14*a* supported on the face wall 26 will be pushed into the housing of the damping cylinder 14, and the opening movement is correspondingly damped.

Because of the relative displacement between the upper housing 19 and the lower housing 22, a doubling of the damping path is achieved.

FIGS. 21 to 26 show a door hinge 3 including one damping cylinder 14, in which case an enlargement of the damping path is achieved here as a result of a lever construction.

As shown in FIGS. 22 to 26, the damping cylinder 14 with its piston rod 14*a* is disposed between two U-shaped rotary levers 30. These rotary levers 30 are pivotably disposed in bores 31 of the housing 6. At its face-side end, the damping cylinder 14 is equipped with a receiving fork 14*c* which permits the connection with the rearward rotary lever 30 facing away from the door 2.

The piston rod 14*a* includes a lever gripper 14*d* which allows the coupling with the forward rotary lever 30 facing the door side.

The rotary levers 30 extend through an oblong-hole-type opening 32 of the linkage of bars 9 whose rearward area having the opening 32 is longitudinally displaceably guided in guide slots 33 of the housing 6. The clear width of the opening 32 is selected such that the rotary levers 30 can extend through this opening 32.

Figure 25:
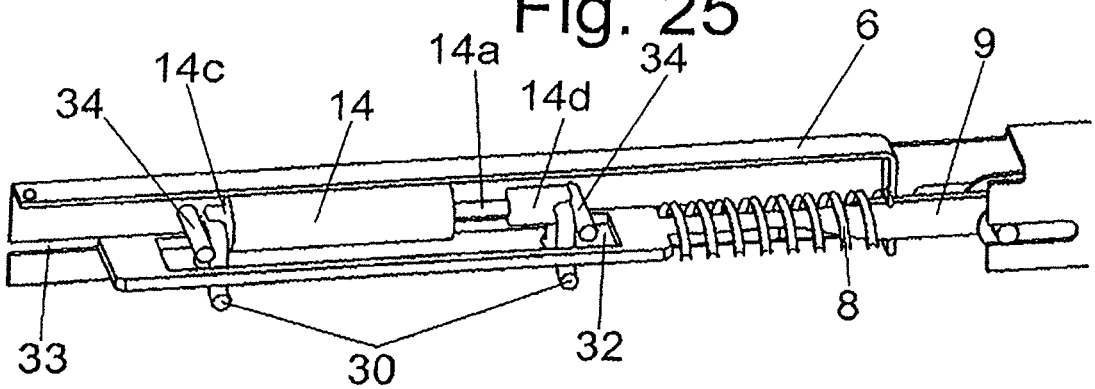
Figure 26:
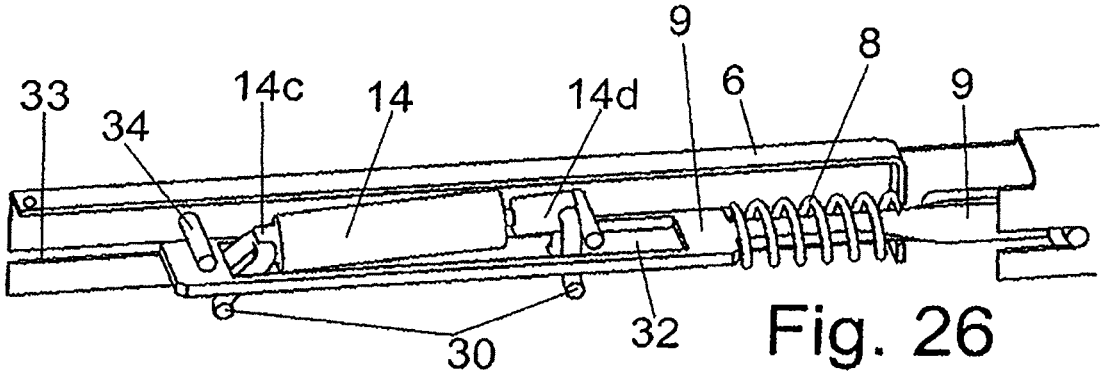
Figure 27:
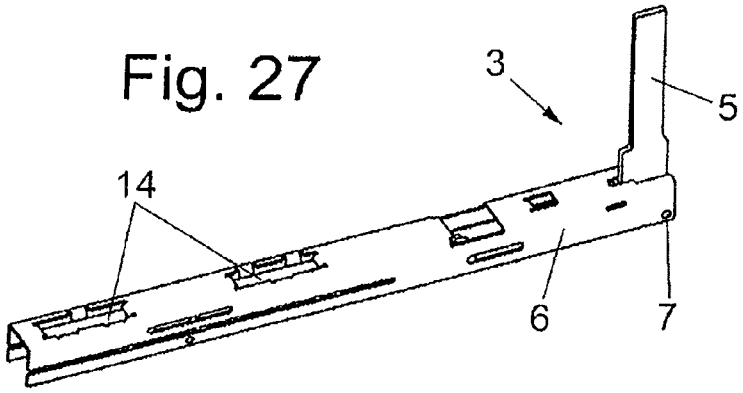
FIG. 27 is a perspective view of another embodiment of a door hinge according to the present disclosure.
Figure 28:
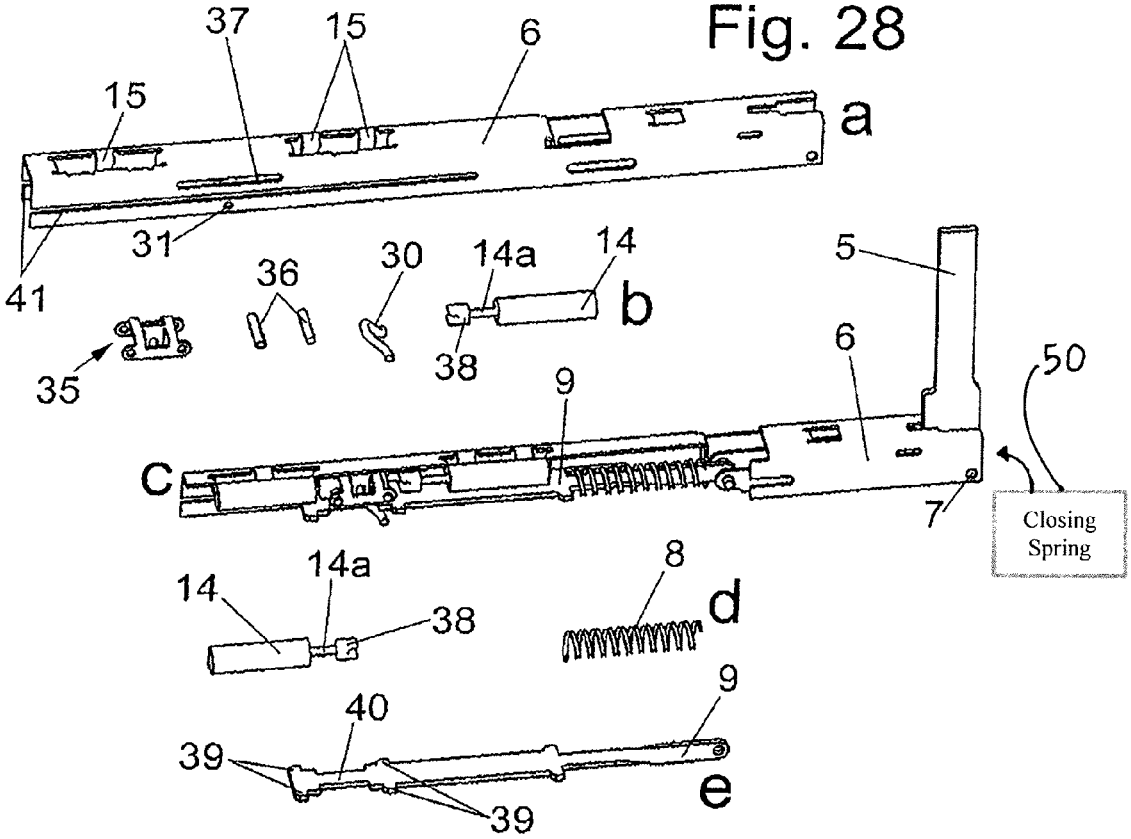
FIGS. 28*a* to *e* are a composite exploded view of the door hinge of FIG. 27.
Figure 30:
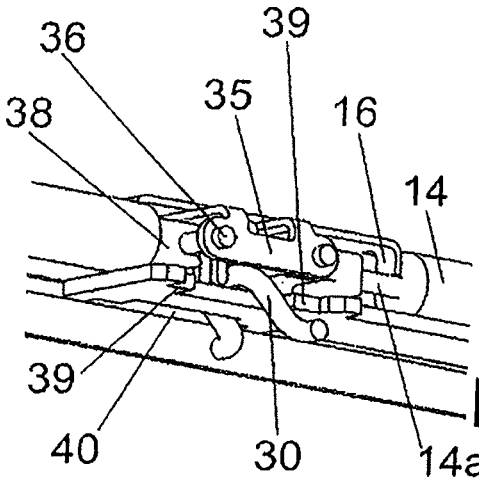
FIGS. 29 and 30 are partial perspective views of the door hinge of FIG. 28 from different viewing angles.
Figure 29:
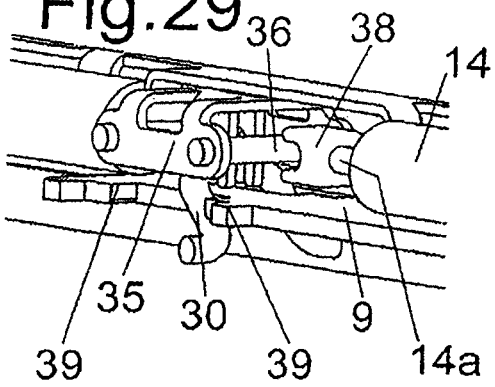

Above the guide slots 33, stop rivets 34 are provided in the housing 6, on which stop rivets 34 the two rotary levers 30 are supported in an approximately perpendicular position in the intermediate opening position of the door 2 when the piston rod 14*a* has moved out, as shown in FIG. 25.

The length of the opening 32 is greater than the distance of the rotary levers 30 from one another, so that a displacement of the linkage of bars 9 from the intermediate opening position in the closing or in the opening direction first has no effect on the damping arrangement 13. When a pivoting position has been reached in which the door is situated approximately 15° before its closing or before its final opening position, the forward or the rearward stop edge 9*b* of the opening 32 impacts on one of the rotary levers 30. A further displacement in the same direction will then cause a pivoting of the acted-upon rotary lever 30 and, in the case of the closing operation, will result in a pushing of the piston rod 14*a* into the damping cylinder 14 or, in the case of the opening, in a displacement of the damping cylinder 14 in the direction of the piston rod 14*a*. Optionally, the closing operation or the opening operation will thereby be damped.

In the case of this embodiment, based on the lever 30 conditions, a clear enlargement of the damping path can be achieved, such as, for example, 2½ times in comparison with the pure or sole displacement path of the linkage of bars 9.

Without influence on the function, in comparison with the installation position of the damping cylinder 14 shown in FIGS. 22 to 26, it is within the scope of the present disclosure to install the damping cylinder 14 in a position that is turned by 180°. That is, in comparison to the present embodiment shown in FIGS. 22-26, the piston rod 14*a* does not point in the direction of the door 2 but in the direction of the rearward side of the body 4 of a household appliance 1.

The receiving fork 14*c* as well as the lever gripper 14*d* create a connection to the rotary levers 30 which permits a pushing as well as a pivoting motion between the above-mentioned components. As a result of the pivoting movement of the respective rotary level 30, the piston rod 14*a*, while the damping cylinder 14 is pivoted, can be pushed into this damping cylinder 14. Likewise, the damping cylinder 14, while being simultaneously pivoted, can be displaced in the direction of the piston rod 14*a* which takes place, for example, during the opening of the door 2. This applies to the present embodiment shown in FIGS. 22 to 26. When the damping cylinder 14 as a whole is installed in a position pivoted by 180°, the corresponding conditions will naturally change. During the closing of the door 2, the damping cylinder 14 will then be displaced in the direction of the piston rod 14*a*, and during the opening of the door 2, the piston rod 14*a* will be displaced in the direction of the damping cylinder 14.

In the embodiment of the present disclosure as shown in FIGS. 27 to 33, two damping cylinders 14 are provided, which are installed inside the housing 6 at a distance from one another while their piston rods 14*a* point to one another.

Figure 13:
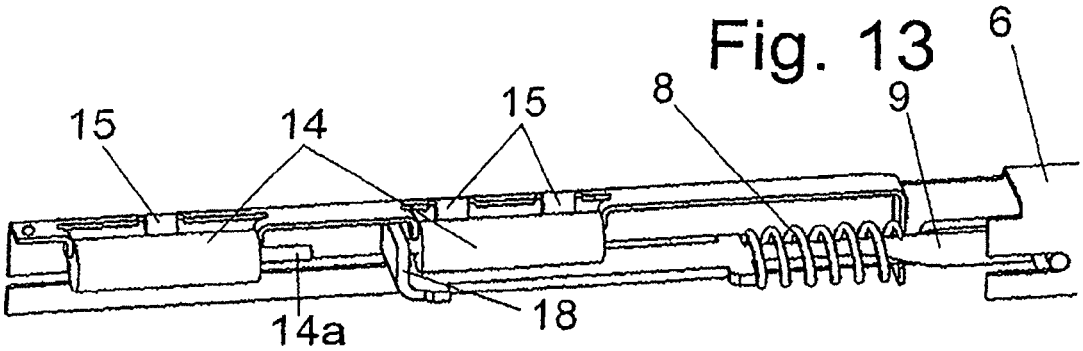
Figure 14:
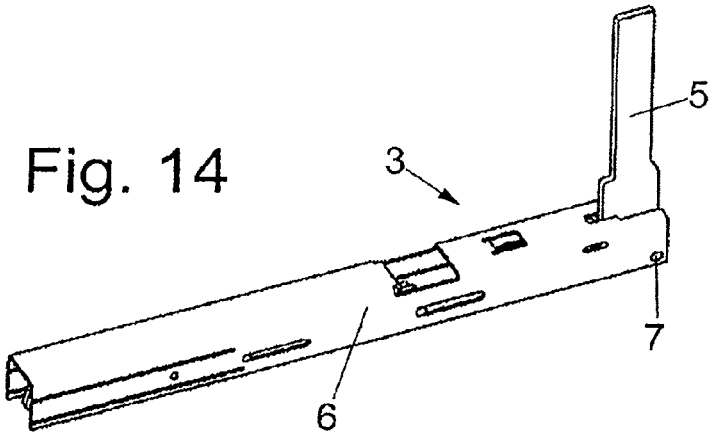
FIG. 14 is a perspective view of another embodiment of a door hinge, according to the present disclosure.
Figure 15:
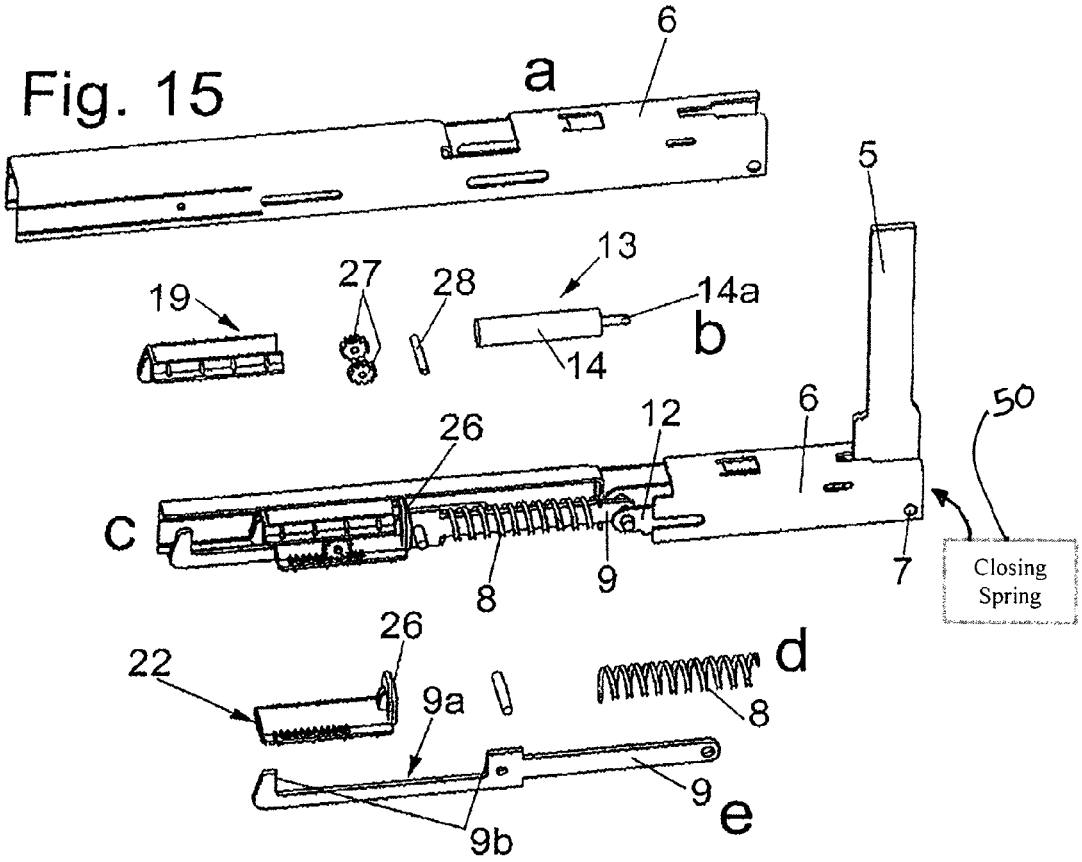
FIGS. 15*a* to *e* are a composite exploded view of the door hinge of FIG. 14.
Figure 23:
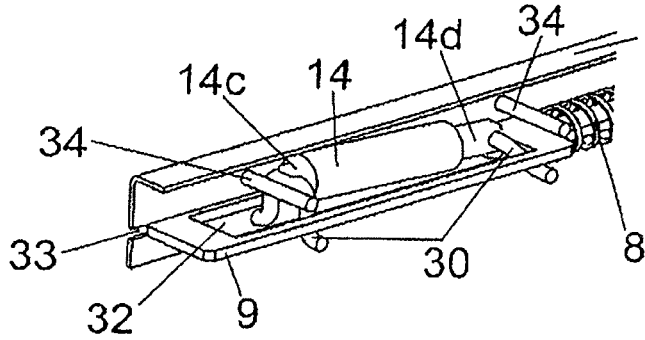
FIG. 23 is a perspective view of the door hinge of FIG. 22.
Figure 24:
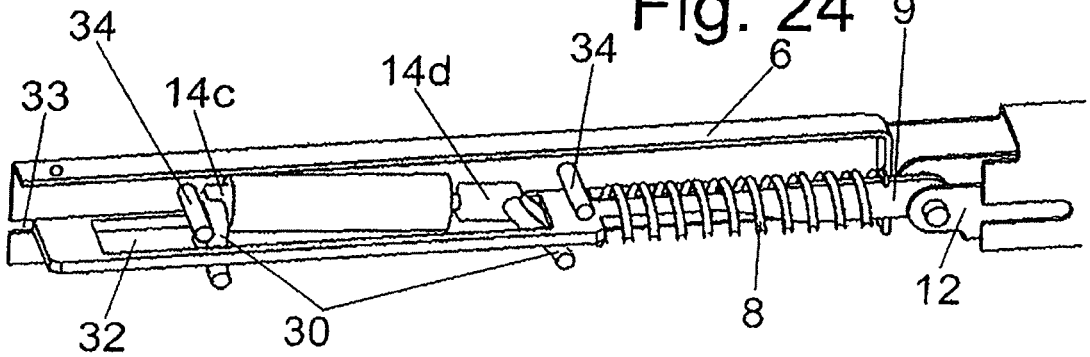
FIGS. 24 to 26 are views of the door hinge of FIG. 22 in different pivoting positions.

The damping cylinders 14 are held inside the housing 6 analogously to the embodiment shown in FIGS. 11 to 13. That is, contour lugs 15 of the housing 6 reach in partially around the housing 6 of the damping cylinders 14, and the housing 6 is secured against an axial displacement by contact lugs 16 resting against the faces of the housing 6. Between the two mutually facing ends of the piston rods 14*a* of the two damping cylinders 14, an approximately U-shaped carriage 35 is guided, to a limited extent, in a longitudinally displaceable manner inside the housing 6 by way of guide rivets 36 engaging in oblong holes 37 of the housing 6. In this case, the guide rivets 36 rest on the center axis of the damping cylinders 14 and thus also their piston rods 14*a*. Rivet grippers 38 are placed at the end side on the piston rods 14*a*, which rivet grippers 38 can each be caused to approach one of the guide rivets 36 and can be pushed onto the guide rivet 36 while partially reaching around the latter.

In the center between the two damping cylinders 14, a U-shaped rotary lever 30 is pivotably disposed in boreholes 31 of the housing 6.

The rearward end of the linkage of bars 9 is equipped with laterally projecting arms 39 between which a contraction 40 is formed. This is more clearly seen in FIG. 28*e*. The arms 39 are displaceably guided within guide slots 41 of the housing 6.

The contraction 40 of the linkage of bars 9 extends through the U-shaped rotary lever 30.

The construction of the embodiment shown permits the following function or operation.

Figure 32:
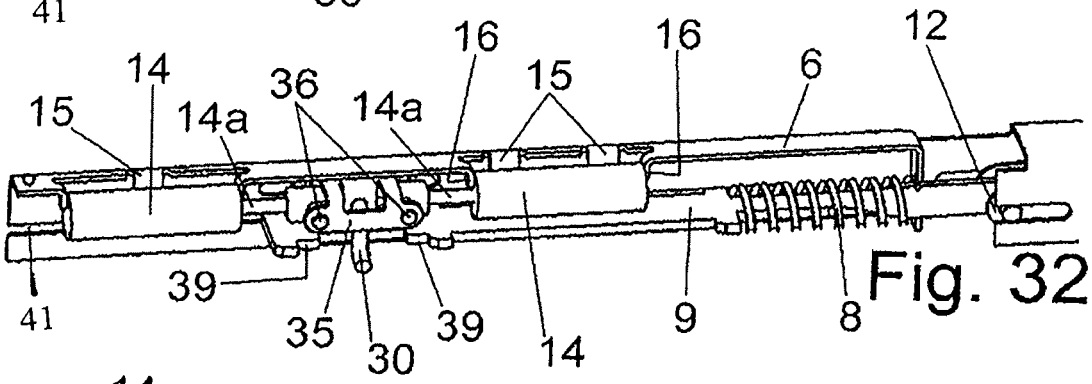
Figure 33:
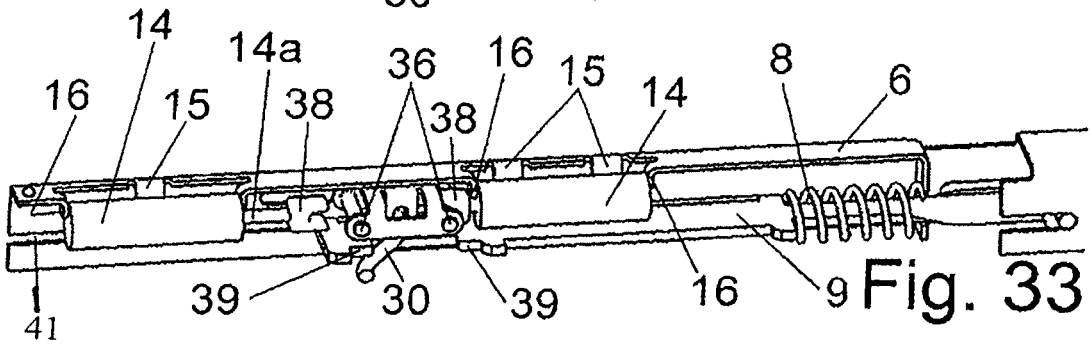

In an intermediate opening position of the door 2, corresponding, for example, to that shown in FIG. 32, the entire damping system is also in an intermediate neutral position. The piston rods 14*a* of both damping cylinders 14 have moved out and rest by way of their rivet grippers 38 against the guide rivets 36 of the carriage 35. However, the entire system is not loaded. The rotary lever 30 is also in a neutral position and stands approximately vertical.

Figure 31:
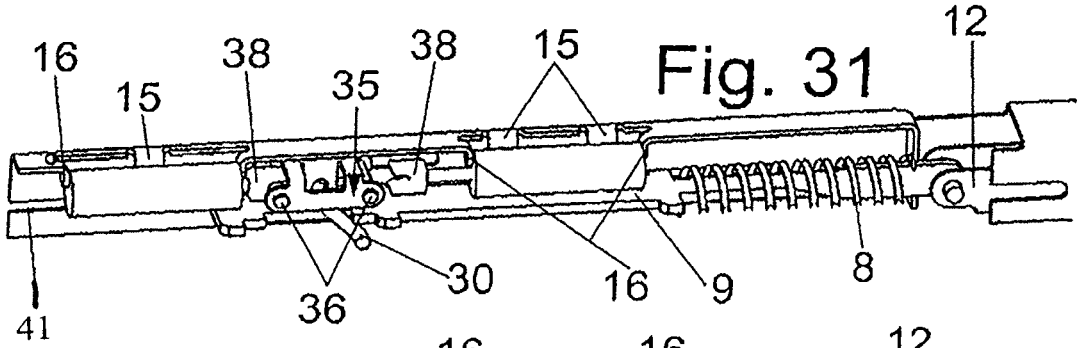
FIGS. 31 to 33 are views of the door hinge of FIG. 28 in different pivoting positions.

When now, by moving the door 2 in the closing direction, the linkage of bars 9 is moved from the position as shown in FIG. 32 to the left, the arms 39 of this linkage of bars 9, which face the door side, impact on the rotary lever 30 and pivot the latter to the left. As a result, the rearward damping cylinder 14 facing away from the door is activated. That is, its piston rod 14*a* is pushed into the damping cylinder 14 into the position as shown in FIG. 31. As a result of the leverage of the rotary lever 30, the push-in path of the piston rod 14*a* is clearly larger than the pure or sole displacement path of the linkage of bars 9. Depending on the design of the rotary lever 30, an enlargement of the damping path by a lever design by the factor of 2.5 is within the scope of the present disclosure.

A similar operation occurs when the door 2 is moved from its intermediate opening position farther into the opening direction. Shortly before a certain opening angle is reached, by way of the rearward arms 39 of the linkage of bars 9 facing away from the door 2, the rotary lever 30 is pivoted toward the right in the manner shown in FIG. 33. The forward damping cylinder 14 facing the door side is correspondingly activated. That is, its piston rod 14 is now pushed into the housing of the damping cylinder 14 while achieving the endeavored damping effect. The damping path is correspondingly larger than would be possible exclusively by displacing only the linkage of bars 9.

In the embodiment shown in FIGS. 14 to 20, a toothed gearing is implemented for enlarging the effective damping path. In the embodiment shown in FIGS. 21 to 33, an enlargement of the effective damping path is achieved by lever mechanisms.

The present disclosure thus relates to a variety of embodiments for a damping of a door hinge 3. It is within the scope of the present disclosure to provide for damping of the closing operation independently of the damping of the opening operation and to differently adjust the respective damping factors.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A door hinge for a household appliance, the door hinge comprising:

a housing mountable to a body of the appliance;

a door lever connected to the housing by a main shaft, the door lever pivotable with respect to the housing about the main shaft; the door lever fastenable to a door of the household appliance, which door is configured to be movable about the main shaft with respect to the body of the household appliance between a substantially vertical closed position and a substantially horizontal opened position;

a weight compensating spring connected to the housing and the door lever, the weight compensating spring configured to maintain the door substantially in a position of equilibrium between the closed position and the opened position during an opening of the door;

a closing spring mounted between said housing and said door lever and configured to provide a self-closing action to close the door without the effect of external forces and to provide a holding-closed force to the door against the body of the household appliance; and a dampening device connected to the housing and the weight compensating spring, the dampening device including at least one damping cylinder retained within the housing by contour lugs that are bent over inwards on the housing, the dampening device configured to counteract a closing force at a time immediately prior to the door reaching the closed position and to counteract an opening force at a time immediately prior to the door reaching the opened position.

2. The door hinge according to claim 1, wherein the damping device includes two damping cylinders, a first of the two damping cylinders providing damping of the closing forces and a second of the two damping cylinders providing damping of the opening forces.

3. The door hinge according to claim 1, further comprising a transmission lever connected between the at least one damping cylinder and the door lever, wherein the transmission lever is articulated on the door lever by a pin that is offset with respect to the main shaft.

4. The door hinge according to claim 3, further comprising a displacement path enlargement mechanism connected between the at least one damping cylinder and the door lever, wherein a displacement path of the transmission lever is increased by the displacement path enlargement mechanism to increase an effective damping path of the at least one damping cylinder.

5. The door hinge according to claim 4, wherein the displacement path enlargement mechanism is a toothed gear mechanism.

6. The door hinge according to claim 5, wherein the toothed gear mechanism includes an upper housing having toothed areas, a lower housing having toothed areas, and gear wheels, wherein the gear wheels are rotatably mounted between the upper housing and the lower housing and mesh with the toothed areas of one or both of the upper housing and the lower housing.

7. The door hinge according to claim 4, wherein the displacement path enlargement mechanism is a lever mechanism.

8. The door hinge according to claim 7, wherein the lever mechanism includes at least one rotary lever that is rotatably mounted in the housing, the at least one rotary lever being configured to be actuated by a movable linkage connected to the transmission lever and mounted on the housing.

9. The door hinge according to claim 7, wherein the damping device includes two damping cylinders, the lever mechanism includes at least one rotary lever that is rotatably mounted in the housing, the at least one rotary lever being configured to be actuated by a movable linkage connected to the transmission lever and mounted on the housing, and further wherein the least one rotary lever engages with and displaces a carriage that is displaceably guided in the housing, and the at least one rotary lever is arranged between the two damping cylinders that are opposite each other and pushes a piston rod of each cylinder into a respective cylinder in response to the displacement of the transmission lever.

* * * * *